US006334727B1

(12) United States Patent
Gueret

(10) Patent No.: US 6,334,727 B1
(45) Date of Patent: Jan. 1, 2002

(54) APPLICATOR AND APPLICATOR ASSEMBLY EQUIPPED WITH SUCH AN APPLICATOR

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/550,588

(22) Filed: Apr. 17, 2000

(30) Foreign Application Priority Data

Apr. 16, 1999 (FR) ..... 99 04816

(51) Int. Cl.[7] ..... A46D 11/00

(52) U.S. Cl. ..... 401/47; 401/190; 401/23; 401/44; 401/202; 401/262

(58) Field of Search ..... 401/190, 23, 44, 401/47, 45, 46, 202, 196, 200, 262

(56) References Cited

U.S. PATENT DOCUMENTS

| | | | | |
|---|---|---|---|---|
| 2,807,816 A | * | 10/1957 | O'Brien | 401/45 |
| 3,266,079 A | | 8/1966 | Schwartzman | |
| 3,345,673 A | | 10/1967 | Schwartzman | |
| 5,002,415 A | | 3/1991 | Gueret | |
| 5,088,849 A | * | 2/1992 | Johnson et al. | 401/47 |
| 5,096,319 A | | 3/1992 | Gueret | |
| 5,324,127 A | * | 6/1994 | Cortez | 401/202 |
| 5,865,194 A | | 2/1999 | Gueret | |

FOREIGN PATENT DOCUMENTS

| | | |
|---|---|---|
| EP | 0 263 329 | 4/1988 |
| EP | 0 374 339 | 6/1990 |
| FR | 2 588 457 | 4/1987 |
| FR | 2 633 498 | 1/1990 |
| FR | 2 744 602 | 8/1997 |
| WO | WO 91/12197 | 8/1991 |

* cited by examiner

*Primary Examiner*—David J. Walczak
(74) *Attorney, Agent, or Firm*—Finnegan, Henderson, Farabow, Garrett & Dunner, LLP

(57) ABSTRACT

An applicator comprises a support which is configured to allow the applicator to be engaged with a container containing a first product, in the form of a gel, cream, or liquid, and an application member on the support. The application member is capable of conveying the first product from an opening defined by the support to an application face of the said application member. The applicator further includes a lid configured to removably cover the applicator member by engaging with the support. In a closed end of the lid there is a second product, in the form of a solid cake or powder. The application face is capable, when the lid is fitted, of being pressed elastically against the second product so that the second product can be loaded onto the application face. Once the first and second products have been loaded onto the application face, the lid can be removed and the application face can be put in contact with a surface to apply the combined first and second products.

290 Claims, 5 Drawing Sheets

APPLICATOR AND APPLICATOR ASSEMBLY EQUIPPED WITH SUCH AN APPLICATOR

The present invention relates to an applicator for use in the separate and/or combined application of at least two products, such as products which contain active ingredients or compounds. The products are contained in separate reservoirs configured to cooperate so as to form an integrated assembly.

Thus, for example, in the context of the application of make-up to the body or to the hair, it is desirable to provide a make-up base in the form of a cream, a gel, or a milk which the user can combine with a separate product, for example in the form of a compacted or loose powder containing colored pigments or fillers. Preferably, it is possible for the separate product to be chosen from a number of powders containing pigments of different colors, so that the user can choose the color and/or the appearance of the make-up to be applied.

Likewise, in the field of sun protection, it may be desirable to have a moisturizing or soothing base in the form of a milk or a cream, which a user can combine with a separate product, for example in the form of a powder or a cream containing a UV filter, which can be chosen from a plurality of powders containing filters having differing protection factors. In this manner, the user can select the desired sun protection to be applied to the skin. For instance, in the first few days of exposure to the sun, it may be desirable to use a product with a high protection factor, while, as the days progress, it may be desirable to use products with decreasing protection factors.

Hence, one of the objects of the invention is to provide an applicator forming a container for one product, wherein the applicator can be used in combination with another container containing another product whose action complements the action of the product contained in the applicator.

Another object of the invention is to provide a stand-alone applicator assembly containing a first product with an application member and a member for fitting the application member on a container containing a second product that is to be used in combination with the first product.

It should be understood that the invention could be practiced without performing one or more of the preferred objects and/or advantages described above. Other objects of the invention will become apparent from the detailed description which follows.

To achieve these and other advantages, and in accordance with the purposes of the invention, as embodied and broadly described herein, a first aspect of the invention includes an applicator comprising a support configured to be removably provided on a container containing a first product, wherein the support defines an opening. An application member having a first end portion mounted on the support and a second end portion having an application face. The application member is configured to convey the first product from the container to the application face via the opening. The application further includes a lid configured to removably cover the application member, the lid having a closed end portion containing a second product arranged such that the application face is capable of being pressed against the second product when the application member is covered with the lid.

There is thus produced, for example, a unit containing one product, such as, for example, a powder or the like, wherein the unit can be fitted onto the container containing another product capable of facilitating the specific product to crumble. The two products are kept separate from one another and are conveyed in metered amounts onto the application face of the application member for the purpose of combined application. In this manner, the product contained in the lid preferably does not soil the product contained in the container prior to their combination. An application member of a given applicator preferably is not brought into contact with a second product other than the one contained in the lid with which it is associated. Preferably, the product contained in the container can be dispensed under pressure, for example by a pump, a piston, a propellent gas, or other suitable mechanisms for dispensing materials under pressure.

At least prior to use, the application face of the application member is forced elastically to press against the free surface of the product contained in the lid. With certain products this pressing is enough to ensure that the application face becomes adequately laden with the product. However, the loading of the application face with the second product also may be encouraged by rotating the application face while it is held pressed against the free surface of the product contained in the lid.

The product may be poured, either in a hot or cold state, or compacted, directly into the closed end of the lid or into a cup mounted in the closed end of the lid. Members, for example in the form of fins or other catching means, may be provided so as to allow the product, when it solidifies, to catch in the closed end of the lid when the product is poured into the lid.

In the case of a product in the form of a loose powder or a cream, a containment member, for example in the form of a grating or perforated mesh, may be provided to keep the second product in the closed end of the the lid, while also allowing the product to contact the application face.

The second product may be separated from the closed end of the lid by an elastically deformable member, such as, for example, a block of foam or a spring. Such a member is able to contribute to pressing the application surface elastically against the second product, especially when the applicator member is made of a material which is not substantially elastically compressible or even not at all elastically compressible. When the elastically deformable member is a foam, particularly an open-cell foam, for example, the product can be anchored in the closed end of the lid when the product is poured in the form of a liquid.

The closed end of the lid may be capable of axial movement, for example by elastic deformation. This characteristic makes it possible to reload the application member with the second product without having to completely refit the lid onto the support, particularly when the lid is a screw-on lid. The axial movement of the closed end may be accomplished by providing a closed end capable of elastic deformation. For example, the closed end may be in the form of a diaphragm made of elastically deformable material. Alternatively, such axial movement may result simply by slide-mounting the closed end, causing the closed end to be forced into an uppermost position under the effect of the elastic compression of the applicator member when the lid is fitted on the support. The lid also may be fitted on the applicator support in a sealed manner.

Preferably, the application member is made of a block of porous material capable of absorbing the first product and conveying the first product from the orifice to the application face of the application member. The application member may, for example, be selected from an open-cell or semi-open-cell foam or a felt. The application face of the application member also may be covered with flocking. In the case of such an absorbent product, particularly in the case of a felt or of an open-cell or semi-open-cell foam, the application member forms a number of "natural" passages formed between fibres or by the pores of the material. These passages intercommunicate and are particularly suitable when the product contained in the container is liquid. In the case of a more viscous product, or in the case of a non-porous material, at least one "artificial" passage may be made in the form of one or more ducts extending, for example, axially through the application member from the support to the application face. This permits the product contained in the container to be conveyed to the application face.

The application member may include an elastically compressible element, and may in particular be in the form of a bellows. Mounted on the elastically compressible element is the application surface, for example in the form of a foam, a woven or a nonwoven, which may or may not be flocked. The application surface may be relatively smooth or may have reliefs capable of performing a massaging action when applied to the skin.

As a preference, near the opening an opening/closing mechanism, or covering element, may be provided, such as, for example, a shutter or valve. The opening/closing mechanism is actuatable in response to pressure applied to the container. Preferably, the opening/closing mechanism is configured to selectively uncover or close off the opening, and is capable of being placed in communication with the container containing the first product. It is thus possible to prevent a liquid or semi-liquid material contained in the application member (formed, for example, of a mixture of the first and second products) from running down, via the opening, into the container containing the first product. Furthermore, the applicator, particularly when the application member is made of an absorbent material, may contain a sufficient quantity of the first product to form a stand-alone applicator unit. This unit, formed essentially of the lid and the application member, may be carried and used throughout the day independently of the container containing the first product.

According to another aspect of the invention, the opening/closing mechanism is actuatable in response to pressure applied to the application face. That is, the opening/closing mechanism is mounted so as to uncover the opening in response to sufficient pressure exerted on the application face. An elastic return mechanism is provided to force the opening/closing mechanism into the closed position in the absence of sufficient pressure on the application face. Thus, the first product is conveyed onto the application face, to be mixed with the second product located there, only in the application position, when the application face is pressed against the surface that is to be treated. Thus, the separation between the first product contained in the container and the second product contained in the lid is improved further.

Alternatively, the opening/closing mechanism can be mounted in such a way as to uncover the opening in response to sufficient pressure exerted on the opposite side of the support to the applicator member. In this case, the opening/closing mechanism will be returned to the closed position when the pressure ceases. Such pressure may be exerted on flexible or deformable walls forming the container, or on a piston forming the bottom of the container. When the user applies a sufficient force on either the deformable walls or a piston, a dose of the said first product is forced out of the container through the opening and onto the application member.

The mechanism for fitting the applicator on the container may, for example, be chosen from a snap-fastening, a screw-fastening or a push-fit mechanism, and preferably is suitable for fitting the applicator on a dispensing member including a pump or valve having a stem.

According to a second aspect of the invention, there is also produced an assembly for the combined application, particularly to the skin, of a first product and of a second product. The applicator assembly comprises a container containing a first product and is capable of allowing the first product to be dispensed under pressure. The assembly further includes at least one applicator according to the first aspect of the invention, wherein the at least one applicator contains a second product.

The container preferably is in the form of a container surmounted by a dispensing member in the form of a pump, such as an airless type pump, or a valve, such as a one-way valve, or is a tube or bottle having deformable walls or is a bottle having a piston forming the bottom of the bottle.

As used herein, the term "airless pump" refers to a pump that provides dispensing of a substance from a container in essentially a single direction without permitting reverse (intake) flow of air via the pump. That is, as product is pumped from the container, the pumped product is not replaced with a corresponding volume of air through the pump. In addition to preventing reverse intake flow of "air," an "airless pump" typically does not allow intake of any other substances to replace the volume of product pumped out of the container. For example, an "airless pump" could include a one-way valve, such as a check valve.

By way of example, the second product is a make-up product and each of a plurality of the applicators that could be used with assembly contains a differing second products, for example products having differing colors and/or appearances.

Also by way of example, the second product can be a product affording protection against UV radiation, and each of the applicators that could be used with the assembly contains a second product having a protection factor that differs from the second product contained in another applicator.

In another alternative, each of the applicators comprises a different type of application member, for example application members permitting differing application characteristics. Thus, particularly according to the surface that is to be treated, application members may be made of foams with differing hardnesses or absorption capabilities.

The first product preferably is in the form of a liquid, a cream or a gel.

Yet another aspect of the invention includes an applicator comprising a support having a first end portion and a second end portion, wherein the first end portion is configured to be removably provided on a first reservoir containing a first product. A second reservoir containing a second product is configured to be engageable with the support. An application member having an application face extends from the second end portion of the support. The application face is capable of being placed in contact with the second product when the second reservoir is engaged with the support. The application member is configured to be selectively loaded with at least one of the first product and the second product on the application face.

Another aspect of the invention includes an applicator assembly comprising the applicator, a container forming the first reservoir, and a lid defining the second reservoir.

Another aspect of the invention includes an applicator comprising a support defining an opening, an application member disposed on the support, and a covering element configured to selectively open and close the opening. A lid containing a product to be applied to a surface also is provided, the lid being configured to removably cover the application member and being capable of placing the application member in contact with the product.

Yet another aspect of the invention includes a process for applying at least one of a first product and a second product using one of the applicators described above. The process includes providing the applicator and a container containing the first product. The applicator support is placed on the container and the lid is placed over the application face. The application face is loaded with at least one of the first and second products and the lid is removed from over the application face. The application face of the application member is then placed in contact with a surface to thereby apply said at least one of the first and second products to the surface.

In the preferred practice of the invention, one or both of the first and second products is a cosmetic product which is applied to the skin and/or hair of an individual. However, the invention in its broadest aspects could be used to apply many different types of products on many different types of surfaces.

Besides the structural and procedural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1A is a cross-sectional view of an applicator according to an aspect of the present invention;

Figure 1A:
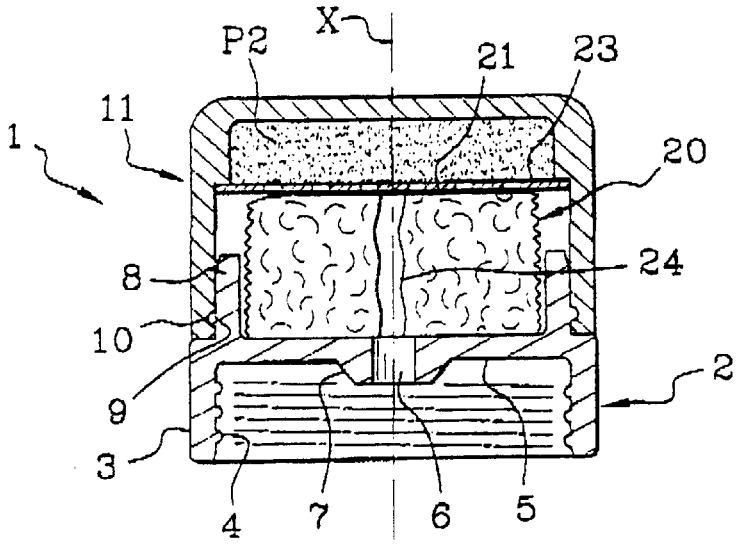
FIG. 1B is a cross-sectional view of an applicator having an opening/closing mechanism actuatable in response to pressure on the container according to another aspect of the present invention.
FIG. 1C is a cross-sectional view of an applicator having an opening/closing mechanism actuatable in response to pressure on the face of the application member according to yet another aspect of the present invention.
FIG. 1D is a cross-sectional view of an applicator having a mechanism permitting axial movement of the closed end of the lid according to yet another aspect of the present invention
FIG. 1E is a cross-sectional view of an applicator having a compressible element interposed between the top of the lid and the second product according to a further aspect of the present invention.

The applicator 1 depicted in the embodiment of FIG. 1A may be essentially in the form of a cap and comprises a support 2 preferably made of a thermoplastic material, such as polypropylene or polyethylene, for example. The support 2 includes a cylindrical lateral skirt 3 having a longitudinal axis X. The internal surface of the skirt 3 has a screw thread 4 designed to engage with a corresponding screw thread provided on a container on which the applicator 1 is intended to be fitted. One end of the lateral skirt 3 is closed by a transverse wall 5. The transverse wall 5 defines an opening 6 at its centre. On the side of the wall 5 facing the cylindrical skirt 3, the opening 6 is surrounded by a collar 7. The collar 7 preferably has a frustoconical profile which, as will be explained hereinafter, forms a skirt configured to make a seal when the applicator 1 is fitted on a container.

On the side opposite to the cylindrical lateral skirt 3, the transverse wall 5 includes another skirt 8. The exterior surface of skirt 8 forms a rib 9 capable of engaging, such as by snap-fastening, for example, with a groove 10 formed on an internal surface of a lid 11. Such an engagement allows the lid 11 to be removably mounted on the support 2. Alternatively, the lid 11 can be screwed onto the skirt 8, or mounted in some other suitable like manner. Similarly, rather than screw threading, skirt 3 may include a snap-fastening mechanism such as the rib 9 or groove 10 shown in FIG. 1A, and may be configured to engage with a corresponding mechanism provided on the container. Mounted on the transverse wall 5 on the opposite side to the skirt 3 is an application member 20 preferably in the form of a block of open-cell foam, such as, for example, polyurethane, polyester, polyether, NBR, SBR, PVC or PVA foam, or other like suitable materials. The block of foam 20 is mounted on the lateral wall 5 of the support 2 by bonding, snap-fastening, welding or other suitable mounting methods. A face 21 of the application member 20, which is the face opposite the support 2, forms an application face which contacts a surface to be treated or applied with a cosmetic or other product, or combination of products as will be described. The block of foam 20 includes an axial duct 24 extending longitudinally through its center. The duct 24 extends between and is in flow communication with the opening 6 of the support 2 and the application face 21. The application member 20 also may be formed of a stack of several blocks of foam, for example blocks with different hardness characteristics, depending on the desired application characteristics. Likewise, the applicator member 20 may be formed of several concentric rings of foam, it being possible for artificial passages for the product to be conveyed to the application surface 21 to be formed at the annular interface between the blocks of foam. The block of foam 20 may also be covered, for example, at its application face 21, with flocking material (not shown).

Placed proximal the closed end of the lid 11 is a second product P2, preferably in the form of a loose powder or compacted solid material. The second product P2 preferably may also include, for example, a make-up powder containing pigments of a given color. When the second product P2 is in the form of a powder, it preferably is held in the closed end of the lid 11 via a containment member 23 extending laterally across an upper portion of the lid 11. The containment member 23 can be in the form of a mesh or grating, for example, and extends laterally across an upper portion of the lid 11. The containment member 23 may be held in the lid 11 by, for example, snap-fastening, and preferably by pressing into a shoulder formed on the interior surface of lid 11. When the lid 11 is fitted on the support 2, the foam 20 is compressed such that the application face 21 is pressed elastically against the containment member 23. In this fitted position, the application face 21 naturally becomes laden with powder, for example by capillary action at the holes in the grating or the mesh 23. The amount of powder transferred onto the application face 21 can be further improved by rotating the lid 11 with respect to the longitudinal axis of support 2.

Figure 2D:
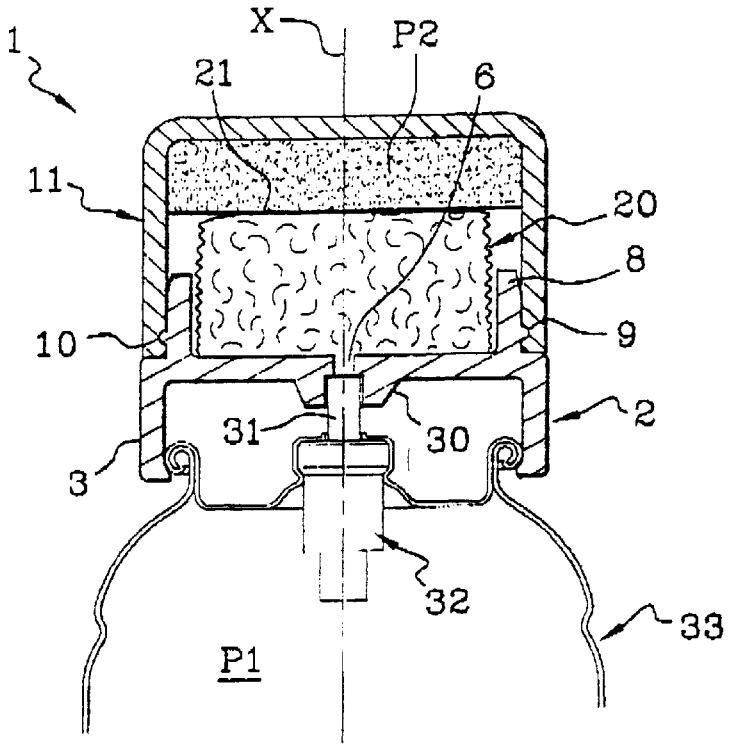
FIG. 2D is a cross-sectional view of an applicator according to an aspect of the present invention mounted on a pressurized container.
Figure 2A:
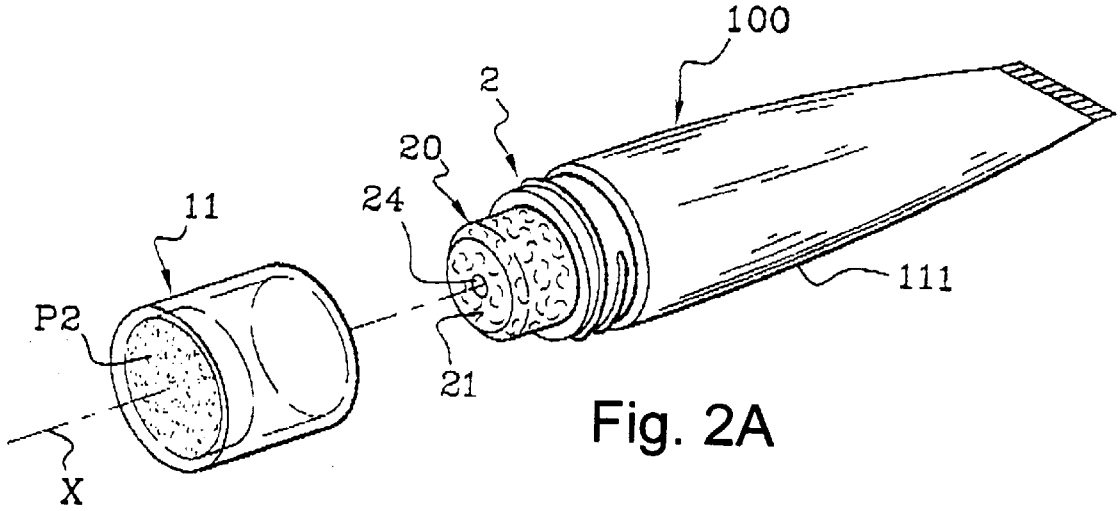
FIG. 2A is a perspective view of an applicator assembly having a container with deformable walls and fitted with an applicator according to an aspect of the present invention.
Figure 2B:
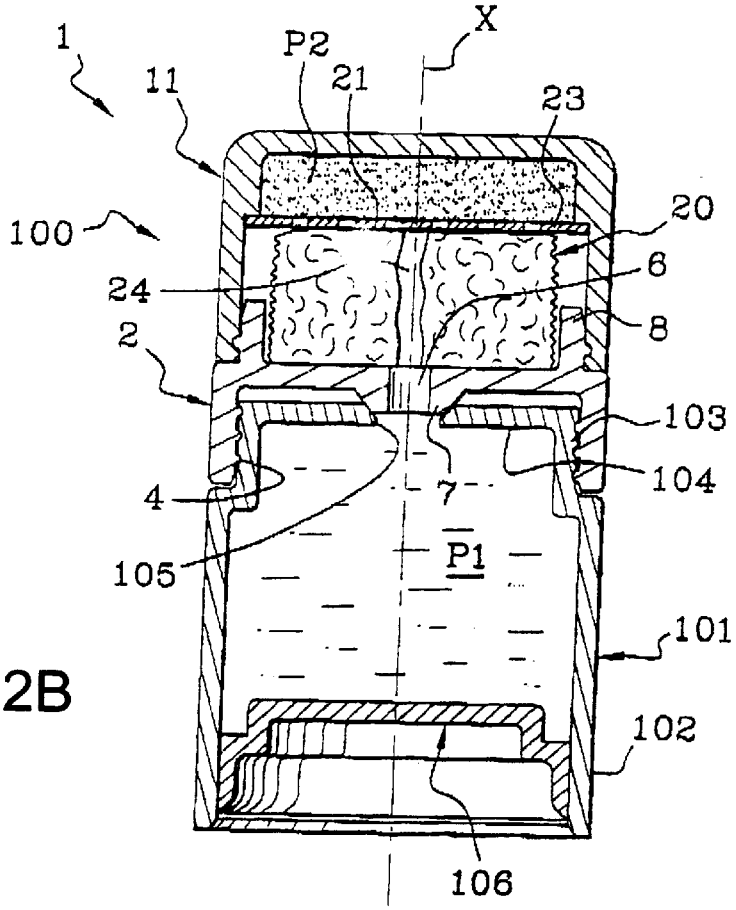
FIG. 2B is a cross-sectional view of an applicator assembly having a container with a piston forming the bottom and fitted with the applicator of FIG. 1A according to an aspect of the present invention.

As shown in FIG. 2B, such an applicator may also be screwed onto a bottle 101 comprising a body 102 of relatively short height and having a neck with a screw thread 103 on one end thereof. The neck ends in a transverse wall 104 defining an opening 105, which preferably has a profile suited to accommodate the frustoconical sealing skirt 7 of the applicator 1. Placed inside the body 102 is a movable end wall forming a piston 106 capable of sliding in a sealed fashion against the interior side walls forming the body 102. Together, the body 102 and the piston 106 define a variable volume reservoir containing a product P1, preferably in the form of a cream, such as, for example, a colorless make-up base. Thus fitted together, the applicator 1 and the bottle 101 form an applicator assembly 100. An assembly 100 of this kind may further comprise a plurality of applicators 1, similar to the applicator discussed with reference to FIG. 1A, with each applicator containing a powder P2 having a color differing from the color of the powder contained in another applicator. The operation of the assembly 100 will now be described.

To use the applicator assembly, first the user selects an applicator 1 containing a powder of desirable color. The applicator is then placed on the bottle 101, for example, by screw fitting. Either before or after opening the lid 11, the user presses on the piston 106 so as to force a certain amount of product P1, preferably in the form of a cream, up into the axial duct 24 of the application member 20. The application member 20 thus simultaneously becomes laden with cream P1, particularly inside the duct 24, and with colored powder P2 on the application face 21. With the embodiment of the applicator according to FIG. 1A, it should be noted that, depending on the viscosity of the product P1 and the compression of the foam forming the application member 20, the product P1 may be forced up into the duct 24 simply as a result of the suction caused by the expansion of the foam of the applicator member 20 as the lid 11 is opened.

After removing the lid 11 from the applicator 1 (and optionally also removing the applicator 1 from the container), the user then applies the application face 21 to the surface to be treated, for example, the face, and moves it around pressing the application face lightly against the skin, preferably in small circular movements. The blending action performed by the applicator member 20 causes the powder and the cream to mix uniformly at the interface between the application face 21 and the skin. If necessary, the user may add some more cream P1 to the mixture, by pressing again on the piston 106. Similarly, the user also may increase the concentration of colored powder by bringing the application face 21 back into contact with the grating 23. After application, the lid 11 is replaced onto the applicator 1.

To apply a different color make-up to another part of the body, such as another part of the face, the applicator 1 is unscrewed from the bottle 101 and an applicator containing a powder P2 having a different color than that of the powder contained in the previous applicator is fit onto the bottle 101. The user then proceeds as discussed hereinabove. Thus, the application face 21 of a given application member 20 is preferably in contact with a single powder of one color, which makes it possible to avoid having to clean the application member between applications of products having differing colors. Moreover, the first product P1 inside the container 101 is preferably never soiled with the second product P2 contained in the closed end of the applicator 1.

The assembly shown in FIG. 2D includes a lid 11 wherein the second product P2 is in the form of a solid cake or compacted solid material that may be obtained by pouring a liquid composition, preferably one based on plaster, into the closed end of the lid 11 in either a hot or cold state so that it solidifies as it cools. A catching mechanism (not shown), such as a fin or a rib, ensures that the product P2 is anchored in the closed end of the lid 11. Thus, the application face 21 of the application member 20 elastically presses directly on the free surface of the product P2. The application member 20 includes a block of open-cell foam which preferably does not have an axial duct of the kind 24 present in the block of foam of the applicator shown in FIG. 1A. The porosity of the material used for application member 20 is great enough to allow a liquid to be conveyed from the opening 6 to the application face 21. The transverse wall 5 of the support 2 forms, on the opposite side to the application member 20, a sleeve 30 which can be push-fitted onto the emerging stem 31 of a valve or pump 32 fitted to a pressurized container 33 that preferably contains a liquid composition P1 capable of causing the product P2 to break apart and crumble. In optional arrangements of the container 33, element 32 may be a one-way valve or an airless pump. The composition P1 travels to the application surface via the pores of the block of open-cell foam that forms the application member 20.

In use, the applicator 1 in FIG. 2D is mounted on the valve stem of a pressurized container 33 via the push-fit sleeve 30. The free end of the lateral skirt 3 of the support 2 is some distance from the container 33 so as to allow the valve 32 to be actuated in response to axial pressure exerted on the lid 11, which actuation causes a dose of the liquid product P1 contained in the pressurized container to be let out. The product P1 travels up through the pores of the applicator member 20, travelling as far as the application face 21 pressing elastically against the free surface of the solid product P2. The product P2 crumbles at the surface as a result of contact with the liquid product P1 on the application face 21. Thus, product P2 is transferred onto the application face 21 of the member 20. After the lid 11 is opened, the application face 21 is moved on the skin so as to apply the combined products laden on its surface. The pressurized container preferably is used as a handle or grasping surface for the applicator member 20.

Figure 1B:
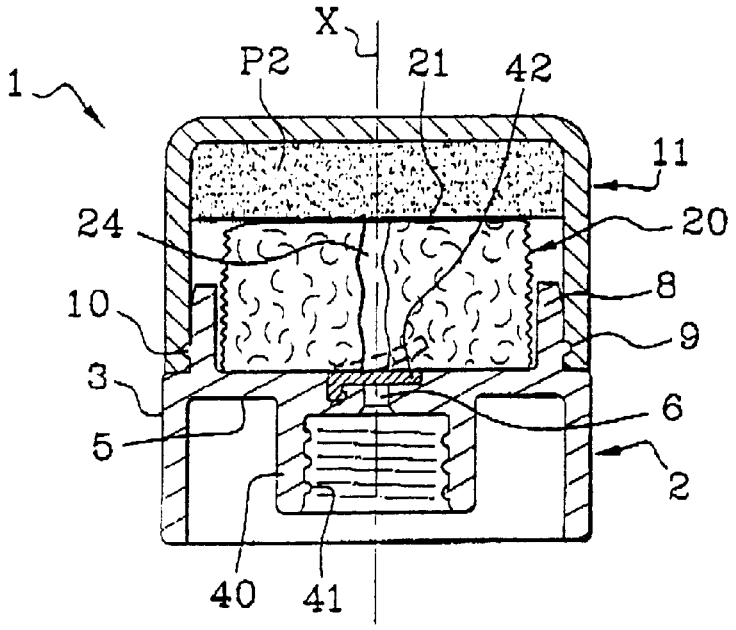

In FIG. 1B, the applicator 1 includes a support 2 bearing, on the face opposite to the application member 20, an outer lateral skirt 3, and an inner skirt 40. The outer lateral skirt 3 forms an outer covering while the inner skirt 40 has an interior surface with a screw thread 41 capable of engaging with a screw thread formed on the neck of a container, for example of the deformable-walled tube type shown in FIG. 2A. The application member 20 preferably includes a block of a soft elastomeric material having an axial duct 24 extending through its center in a manner similar to that which was described with reference to FIG. 1A. By way of example, materials that can be used to make the application member 20, include silicone, nitrile, butyl, latex, polyethylene, polypropylene or polyurethane elastomers, and other similar suitable materials. The product P2 contained in the lid 11 preferably is of the same type as the product in the applicator 1 described with reference to FIG. 2D, and preferably has the form of a compacted solid material containing colored pigments.

In FIG. 2A, the applicator assembly 100 includes a deformable-walled tube 111 containing, for example, a cosmetic milk. As a preference, the lid 11 is transparent so that the user can see the color of the product P2 contained in the applicator 1 from the outside. The tube may be made of materials such as polypropylene or polyethylene, or other similar materials. The milk contained in the tube preferably is used as a make-up base and also causes the compacted powder contained in the lid 11 of the applicator to break up and crumble more easily, thus improving application. Such a flexible tube type of container similar to that depicted in FIG. 2A also may be provided with a removable applicator similar to that shown in FIG. 2B instead of the applicator shown in FIG. 2A. It also may be possible to provide a container similar to that depicted in FIG. 2A with an applicator similar to the one shown in FIG. 1B.

As shown in FIG. 1B, the opening 6 of the support 2 is selectively closed off by a shutter 42, capable of moving away from the edge of the transverse wall 5 defining the opening 6 under an increase in pressure of the product P1 contained in the tube 111 caused in response to a compressive force exerted by the user on the walls of the tube 111. The shutter 42 will return against the rigid seat formed by the edge of the transverse wall 5 when the increase in pressure of the product P1 ceases, i.e., when the user no longer exerts a sufficient compressive force on the walls of the tube 111. The elasticity of the application member 20, combined with the pressure decrease inside the tube, encourages the shutter 42 to return to its seat when the pressure of the product P1 ceases. The presence of a shutter allows the user, having loaded the applicator with product P1, to remove the applicator 1 and place it in a handbag, or the like, for use as a stand-alone applicator unit. This is accomplished as a result of the shutter serving as a closing mechanism that prevents any product from flowing out of the application member 20 via the opening 6.

Figure 1C:
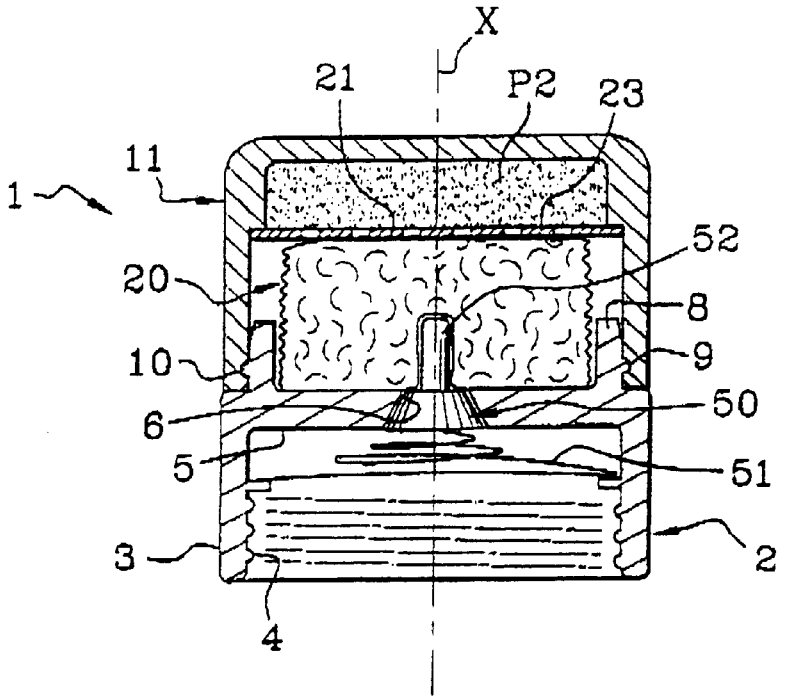

The applicator 1 shown in FIG. 1C has a product P1 in liquid form and is conveyed from the opening 6 to the application face 21 via the pores of an open-cell foam forming the application member 20. The opening 6 defined by the transverse wall 5 of the support 2 is closed off by a valve 50, preferably having frustoconical shape. The valve 50 may be a one-way valve. The valve 50 is configured to selectively rest in a sealed fashion against a seat of frustoconical shape formed by the edge of the transverse wall 5 defining the opening 6. The valve 50 is forced into the closed position by a spring 51 arranged on a side of the transverse wall 5 opposite the application member 20. On the same side as the application member 20, a peg or stem 52 extends in a vertical direction from the valve 50 and projects into the foam that forms the application member 20. This facilitates the opening of the valve 50 in response to pressure exerted on the application face 21 when it is pressed against a surface to be treated. Preferably, the bearing force generated by the compression of the application member 20 inside the applicator is not enough to cause the valve 50 to open. The remaining elements of the applicator are similar to those described with reference to the applicator of FIG. 1A.

Figure 2C:
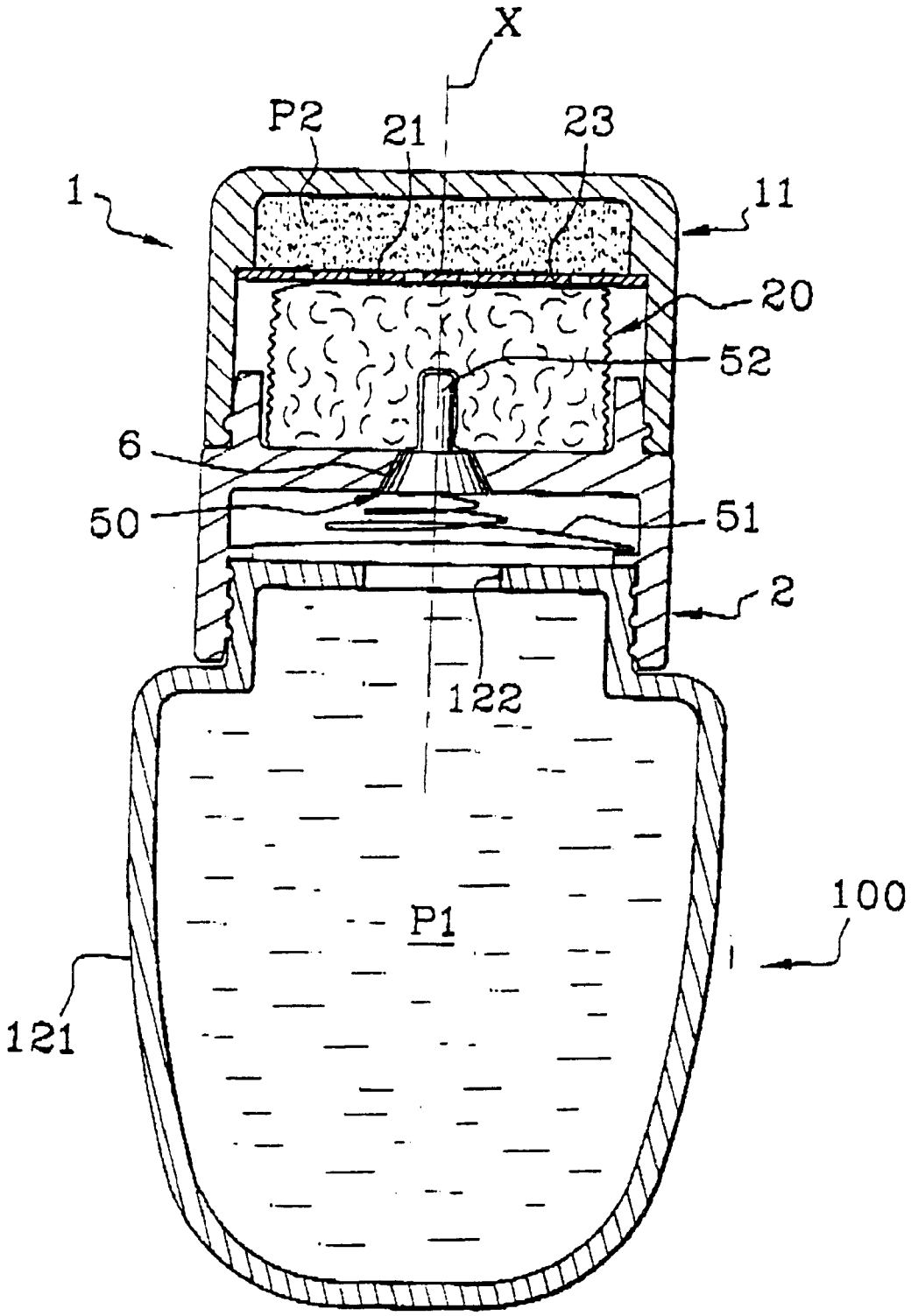
FIG. 2C is a cross-sectional view of an applicator assembly having a container with deformable walls and fitted with the applicator of FIG. 1C according to another aspect of the present invention.

The applicator of FIG. 1C is depicted in FIG. 2C fitted onto an applicator assembly 100 formed by a bottle with deformable walls 121. The bottle preferably contains a product P1, such as, for example, a moisturizing lotion. An opening 122 is in flow communication with the portion of the support 2 below transverse wall 5, and thus also with valve 50. The product P2 contained in the applicator 1 preferably is in the form of a loose powder containing a sun filter.

Upon application, the user fits the applicator 1 containing a powder having the desired sun protection factor onto the bottle 100. The lid 11 is removed and the application face 21 covered with powder P2 is pressed against the surface to be treated, exerting enough force so as to cause the valve 50 to open. Exerting pressure on the walls of the bottle 100 causes the product P1 to be expelled through the opening 6 and conveyed onto the application face 21 via the pores of the foam forming the application member 20. The mixture is thus spread by moving the application face appropriately over the surface being treated. By releasing the pressure of the application face 21 against the surface being treated, the valve 50 closes again under the return force of the spring 51. Once again, the presence of the valve allows the applicator, having been supplied with product P1, for instance at the start of the day, to be used as a stand-alone application unit throughout the remainder of the day.

Figure 1D:
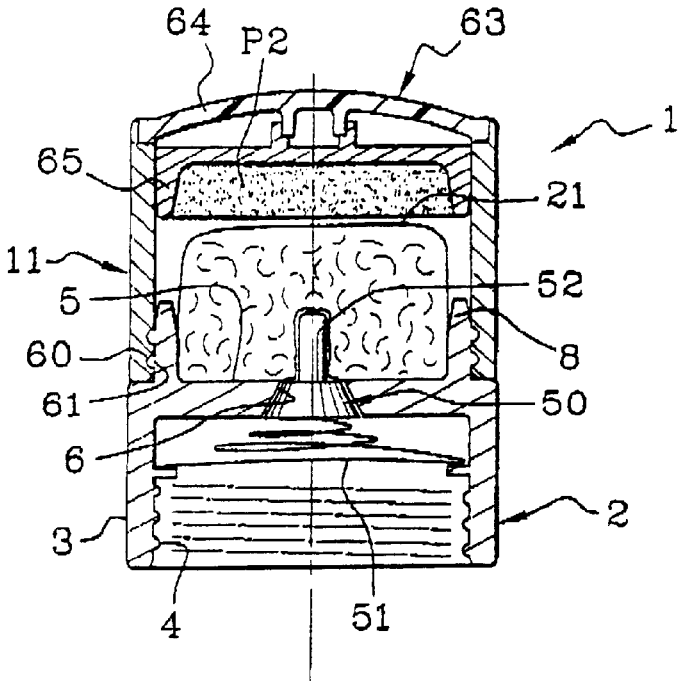

The applicator shown in FIG. 1D differs from the applicator shown in FIG. 1C in that the lid 11 is screwed, as opposed to snap-fitted, onto the support 2 by a screw thread 60 that engages with a corresponding screw thread 61 made on the skirt 8 of the support 2. The lid 11 is thus mounted on the support 2 in a sealed manner. Moreover, the applicator in FIG. 1D includes a closed end 63 of the lid 11 made in the form of an elastically deformable diaphragm 64. Preferably, the diaphragm 64 is two-shot injection molded with the lid 11. However, other suitable methods of forming the diaphragm are within the scope of the invention. The diaphragm 64 is attached to a cup 65 in which the product P2 is compacted. In a storage position, the application surface 21 is kept away from the free surface of the product P2. For the purposes of application, the user exerts axial pressure on the elastically deformable diaphragm 64 so as to bring the surface 21 into elastic contact with the free surface of the product P2, thus allowing the application surface to be loaded with the product P2. By releasing the pressure exerted on the movable closed end 63, the diaphragm 64 elastically returns to its initial position. To use the applicator, the lid 11 is unscrewed and the application surface 21 is pressed against the skin with enough force so as to cause the valve 50 to open. By exerting pressure on the walls of the container, which may be of the type depicted in FIG. 2C, or of another similar type of container, the product P1 is expelled from the container and conveyed to the application surface 21 through the pores of the material forming the application member 20. During application, the product P1 is applied as a mixture with the product P2.

Figure 1E:
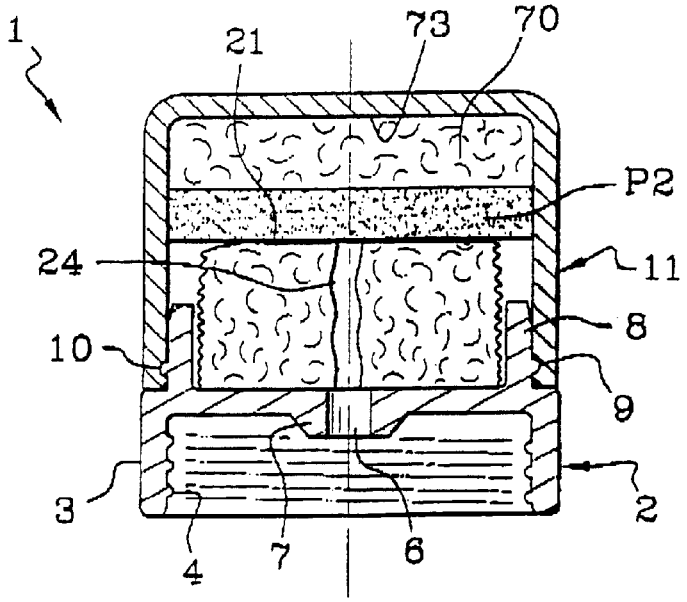

The applicator shown in FIG. 1E differs from that of FIG. 1A mainly in that a compressible element 70, such as a block of foam for example, is interposed between the product P2 and the closed end 73 of the lid 11. The element 70 can be attached to the closed end 73 of the lid 11 by, for example, bonding or other suitable attaching mechanisms. Such a compressible element improves the elasticity of the contact between the application surface 21 and the free surface of the product P2, especially if the application member 20 has little or no elasticity, as with a material such as felt, for example. Furthermore, by using a block of open-cell foam 70, the product P2 can be anchored in the pores of the foam when the product is poured in liquid form. The way in which the applicator 1 according to this embodiment works is essentially the same as was described with reference to the discussion of the applicator of FIG. 1A.

According to another aspect of the invention, a container containing a product P1 may be associated with a plurality of applicators containing substantially the same product P2 but having application members of differing characteristics, such as, for example, differing hardness, softness or absorption characteristics, or combinations thereof. Thus, the user can choose the applicator having an application member that allows for the desired application characteristics, particularly chosen according to the area of the body to be treated. The application member may have any shape, also chosen according to the surfaces to be treated. The applicator may also, when fitted on a given container, be arranged along the longitudinal axis of the container or along a different axis, depending on the desired movements to be performed during application to a surface.

Preferably, the applicator assembly of the present invention is used to store, dispense, and apply cosmetic, pharmaceutical, or dermo-pharmaceutical products. However, in its broadest aspects, the present invention could be used to store, dispense, and apply many other types of flowable substances, including those that are not normally applied to exterior portions of a body. Furthermore, sizes of various structural parts and materials used to make these parts are illustrative and exemplary only and one of ordinary skill in the art would recognize that these materials and sizes can be changed as necessary to product different effects or desired characteristics of the dispensing assembly. Additionally, the various containers, lids, and application members can be combined to form various applicator assemblies other than the ones specifically disclosed above and are contemplated as within the scope of the invention. Similarly, the various features of either the containers, the lids, or the application members could be combined in ways not specifically disclosed above.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

In the foregoing detailed description, reference was made to some preferred embodiments of the invention. It is obvious that variations can be made thereto without departing from the spirit of the invention as claimed hereinafter.

What is claimed is:

1. An applicator comprising:

a support configured to be removably provided on a container containing a first product, the support defining an opening;

an application member having a first end portion mounted on the support and a second end portion having an application face at least partially comprising a porous material, the application member being configured to convey the first product from the container to the application face via the opening; and a lid configured to removably cover the application member, the lid having a closed end portion containing a second product arranged such that the application face is capable of being pressed against the second product when the application member is covered with the lid.

2. The applicator of claim 1, wherein the application member is elastically compressible.

3. The applicator of claim 1, wherein the first product is chosen from a liquid and a semi-liquid material and the second product is chosen from a powder and a solid cake material.

4. The applicator of claim 1, wherein the lid is configured to be removably engaged with the support.

5. The applicator of claim 1, wherein the second product is one of poured and compacted into the closed end portion of the lid.

6. The applicator of claim 1, wherein the second product is one of poured and compacted into a cup mounted in the closed end portion of the lid.

7. The applicator of claim 1, wherein the second product is separated from a closed end of the lid by an elastically deformable member.

8. The applicator of claim 1, wherein the closed end portion of the lid is configured to move axially with respect to the application member when the lid covers the application member.

9. The applicator of claim 1, wherein a containment member is disposed in the lid to contain the second product in the closed end portion of the lid.

10. The applicator of claim 9, wherein the containment member is chosen from a grating and a perforated mesh.

11. The applicator of claim 1, wherein the application member is configured to absorb the first product and to convey the first product from the opening to the application face.

12. The applicator of claim 11, wherein the porous material is chosen from an open-cell foam, a semi-open-cell foam, and a felt.

13. The applicator of claim 1, wherein the application member defines a passage extending from the opening in the support to the application face.

14. The applicator of claim 1, further comprising a covering element configured to selectively cover and uncover the opening in the support.

15. The applicator of claim 14, wherein the covering element is configured to uncover the opening in response to sufficient pressure exerted on the application face.

16. The applicator of claim 15, wherein the covering element is configured to be elastically forced into a position covering the opening in the absence of sufficient pressure on the application face.

17. The applicator of claim 1, wherein the support includes a mounting mechanism chosen from a snap-fastener, a screw-fastener, and a push-fitting mechanism for removably mounting the support on the container.

18. An applicator assembly for applying at least one of a first and a second product to a surface, comprising:

a container containing the first product; and the applicator of claim 1 configured to be removably engaged with the container.

19. The applicator assembly of claim 18, wherein the container is chosen from a deformable tube, a bottle having at least one deformable wall, and a bottle defined in part by at least one movable piston.

20. The applicator assembly of claim 18, wherein the container includes a dispensing member to dispense the first product.

21. The applicator assembly of claim 20, wherein the dispensing member is chosen from an airless pump and a one-way valve.

22. The applicator assembly of claim 18, further comprising a plurality of lids containing second products having differing characteristics.

23. The applicator assembly of claim 22, wherein the second product in the lids is chosen from make-up products having at least one of differing shades and differing appearances.

24. The applicator assembly of claim 22, wherein the second product in the lids is chosen from products having differing sun protection factors.

25. The applicator assembly of claim 18, wherein the application member is made of a material chosen from materials having differing application characteristics.

26. The applicator assembly of claim 18, wherein the first product is chosen from a liquid, a cream, and a gel.

27. An applicator comprising:

a support having a first end portion and a second end portion, the first end portion being configured to be removably provided on a first reservoir containing a first product;

a second reservoir containing a second product, the second reservoir being configured to be engageable with the support; and an application member extending from the second end portion of the support, the application member having an application face at least partially comprising a porous material and being capable of being placed in contact with the second product when the second reservoir is engaged with the support, wherein the application member is configured to be selectively loaded with at least one of the first product and the second product on the application face.

28. The applicator of claim 27, wherein the application member defines at least one passage and one of the first and second products is loaded onto the application face through the passage.

29. The applicator of claim 27, wherein the second end portion includes an engagement member for removable engagement with the second reservoir, said engagement member being chosen from a snap-fit mechanism and a threaded surface.

30. The applicator of claim 27, wherein the application member is configured to be selectively loaded with the first product and the second product and to mix together the first and second products loaded thereon during application of the products to a surface.

31. The applicator of claim 27, further comprising the first reservoir containing the first product, wherein one of the first product and the second product is chosen from a liquid, a cream, and a gel, and the other of the first product and the second product is chosen from a powder and a solid cake material.

32. The applicator of claim 27, further comprising the first reservoir, wherein the first reservoir is formed by a container having a variable volume.

33. The applicator of claim 32, wherein the container includes at least one wall formed of a movable piston.

34. The applicator of claim 32, wherein the container includes at least one wall that is deformable.

35. The applicator of claim 34, wherein the container is a tube made of a material chosen from polyethylene and polypropylene.

36. The applicator of claim 34, wherein the container is a bottle.

37. The applicator of claim 32, wherein the first end portion of the support is configured to fixedly engage with the container.

38. The applicator of claim 32, wherein the container has an opening in one end, said opening being configured to place the first reservoir in selective flow communication with the application member when the application member is engaged with the container.

39. The applicator of claim 38, wherein the opening places the first reservoir in flow communication with at least one passage defined by the application member.

40. The applicator of claim 39, wherein the first product is delivered through the opening in the container and into the passage defined by the application member upon selectively loading the application member with the first product.

41. The applicator of claim 40, wherein the passage is formed by a duct extending longitudinally through the application member.

42. The applicator of claim 40, wherein the application member is made of a foam material having a plurality of passages in the form of pores.

43. The applicator of claim 27, wherein the first end portion defines an opening configured to place the first reservoir in flow communication with the application member.

44. The applicator of claim 43, wherein the opening in the first end portion is selectively closed off by a covering element.

45. The applicator of claim 44, wherein the covering element is configured to open the opening to establish flow of the first product from the first reservoir to the application member.

46. The applicator of claim 45, wherein the covering element is configured to open in response to a pressure increase in the first reservoir relative to the pressure of the applicator.

47. The applicator of claim 45, wherein the covering element is configured to open in response to a sufficient compressive force exerted on the container.

48. The applicator of claim 27, wherein the second reservoir is a lid configured to cover the application member during engagement with the second end portion of the support.

49. The applicator of claim 48, wherein the lid includes a top wall, a side wall, and a containment member extending laterally within the lid proximal the top wall.

50. The applicator of claim 49, wherein the containment member is chosen from a grating and a mesh material that allows at least some of the second product to pass therethrough.

51. The applicator of claim 50, wherein the application face is configured to be in contact with the containment member when the second end portion of the support is engaged with the lid.

52. The applicator of claim 48, wherein the second product is provided near a top portion of the lid.

53. The applicator of claim 52, wherein the top portion of the lid includes an actuator configured to selectively place the application face and the second reservoir in contact when the lid is engaged with the second end portion of the support.

54. The applicator of claim 53, wherein the actuator includes a diaphragm configured to move the second product with respect to the lid.

55. The applicator of claim 48, wherein the second product is chosen from a powder and a cake material.

56. The applicator of claim 55, wherein the second product is a material providing sun protection.

57. The applicator of claim 55, wherein the second product is a colored make-up product.

58. The applicator of claim 55, wherein the second product is configured to crumble upon contacting a liquid or semi-liquid material.

59. An applicator assembly comprising:

the applicator of claim 27, wherein the second reservoir is defined by a lid; and a container including the first reservoir.

60. The applicator assembly of claim 59, wherein the first product is chosen from a liquid, a gel, and a cream, and the second product is chosen from a powder and a solid cake material.

61. The applicator assembly of claim 59, wherein the second product includes a material providing sun protection.

62. The applicator assembly of claim 60, comprising a plurality of applicators, each applicator being configured to engage one of a plurality of lids, the second product in each of the plurality of lids providing differing sun protection.

63. The applicator assembly of claim 59, wherein the second product includes a colored make-up product.

64. The applicator assembly of claim 60, comprising a plurality of applicators, each applicator being configured to engage one of a plurality of lids, the second product in each lid having a differing color.

65. A process for applying at least one of a first product and a second product, comprising:

providing the applicator of claim 1 and the container containing the first product;

placing the support on the container;

placing the lid over the application member;

loading the application face of the application member with at least one of the first and second products;

removing the lid from over the application member; and placing the application face of the application member in contact with a surface to thereby apply said at least one of the first and second products to the surface.

66. The process of claim 65, further comprising applying a compressive force to the container to load the application face with the first product.

67. The process of claim 65, wherein the placing of the lid on the application member loads the application face with the second product.

68. The process of claim 65, further comprising providing a plurality of applicators each having a lid containing a second product having a differing characteristic, and selecting one of the applicators based on the differing characteristic.

69. The process of claim 65, wherein at least one of the first and second products is a cosmetic product, and wherein the surface to which said at least one product is applied is one of hair and skin of an individual.

70. The process of claim 65, further comprising flowing the first product from the container to the application member, and removing the applicator from the container.

71. The process of claim 65, wherein both of the first and second products are applied to the surface.

72. A process for applying at least one of a first product and a second product, comprising:

providing the applicator of claim 27 and the first reservoir containing the first product;

placing the support on the first reservoir;

engaging the second reservoir with the support;

loading the application face of the application member with at least one of the first and second products; and placing the application face of the application member in contact with a surface to thereby apply said at least one of the first and second products to the surface.

73. The process of claim 72, further comprising applying a compressive force to the first reservoir to load the application face with the first product.

74. The process of claim 72, wherein the engaging of the second reservoir loads the application face with the second product.

75. The process of claim 72, further comprising providing a plurality of applicators each having a second reservoir containing a second product having a differing characteristic, and selecting one of the applicators based on the differing characteristic.

76. The process of claim 72, wherein at least one of the first and second products is a cosmetic product, and wherein the surface to which said at least one product is applied is one of hair and skin of an individual.

77. The process of claim 72, further comprising flowing the first product from the first reservoir to the application member, and removing the applicator from the first reservoir.

78. The process of claim 72, wherein both of the first and second products are applied to the surface.

79. An applicator comprising:

a support defining an opening;

an application member disposed on the support;

a covering element configured to selectively open and close the opening; and a lid containing a product to be applied to a surface, said lid being configured to removably cover the application member and being capable of placing the application member in contact with the product.

80. The applicator of claim 79, wherein said support is configured to removably engage with a container containing another product.

81. The applicator of claim 80, wherein the covering element is configured to selectively open in response to an increase in pressure of the product in the container relative to the application member to thereby enable flow of the product from the container to the application member.

82. The applicator of claim 79, wherein the lid is chosen from a plurality of lids containing products having differing characteristics.

83. An applicator comprising:

a support configured to be removably provided on a container containing a first product, the support defining an opening;

an application member having a first end portion mounted on the support and a second end portion having an application face, the application member being configured to convey the first product from the container to the application face via the opening;

a selective flow communication element configured to selectively provide flow communication between the application member and the container via the opening; and a lid configured to removably cover the application member, the lid having a closed end portion containing a second product arranged such that the application face is capable of being pressed against the second product when the application member is covered with the lid.

84. The applicator of claim 83, wherein the application member is elastically compressible.

85. The applicator of claim 83, wherein the first product is chosen from a liquid and a semi-liquid material and the second product is chosen from a powder and a solid cake material.

86. The applicator of claim 83, wherein the lid is configured to be removable engaged with the support.

87. The applicator of claim 83, wherein the second product is one of poured and compacted into the closed end portion of the lid.

88. The applicator of claim 83, wherein the second product is one of poured and compacted into a cup mounted in the closed end portion of the lid.

89. The applicator of claim 83, wherein the second product is separated from a closed end of the lid by an elastically deformable member.

90. The applicator of claim 83, wherein the closed end portion of the lid is configured to move axially with respect to the application member when the lid covers the application member.

91. The applicator of claim 83, wherein a containment member is disposed in the lid to contain the second product in the closed end portion of the lid.

92. The applicator of claim 91, wherein the containment member is chosen from a grating and a perforated mesh.

93. The applicator of claim 83, wherein the application member defines a passage extending from the opening in the support to the application face.

94. The applicator of claim 83, wherein the selective flow communication element comprises a covering element configured to selectively cover and uncover the opening in the support.

95. The applicator of claim 94, wherein the covering element is configured to uncover the opening in response to sufficient pressure exerted on the application face.

96. The applicator of claim 95, wherein the covering element is configured to be elastically forced into a position covering the opening in the absence of sufficient pressure on the application face.

97. The applicator of claim 83, wherein the support includes a mounting mechanism chosen from a snap-fastener, a screw-fastener, and a push-fitting mechanism for removably mounting the support on the container.

98. An applicator comprising:

a support having a first end portion and a second end portion, the first end portion being configured to be removably provided on a first reservoir containing a first product;

a second reservoir containing a second product, the second reservoir being configured to be engageable with the support;

an application member extending from the second end portion of the support, the application member having an application face capable of being placed in contact with the second product when the second reservoir is engaged with the support; and a selective flow communication element configured to selectively place the application member in flow communication with the first reservoir, wherein the application member is configured to be selectively loaded with at least one of the first product and the second product on the application face.

99. The applicator of claim 98, wherein the application member defines at least one passage and one of the first and second products is loaded onto the application face through the passage.

100. The applicator of claim 98, wherein the second end portion includes an engagement member for removable engagement with the second reservoir, said engagement member being chosen from a snap-fit mechanism and a threaded surface.

101. The applicator of claim 98, wherein the application member is configured to mix together the first and second products loaded thereon during application of the products to a surface.

102. The applicator of claim 98, further comprising the first reservoir containing the first product, wherein one of the first product and the second product is chosen from a liquid, a cream, and a gel, and the other of the first product and the second product is chosen from a powder and a solid cake material.

103. The applicator of claim 98, further comprising the first reservoir, wherein the first reservoir is formed by a container having a variable volume.

104. The applicator of claim 103, wherein the container includes at least one wall formed of a movable piston.

105. The applicator of claim 103, wherein the container includes at least one wall that is deformable.

106. The applicator of claim 105, wherein the container is a tube made of a material chosen from polyethylene and polypropylene.

107. The applicator of claim 105, wherein the container is a bottle.

108. The applicator of claim 103, wherein the first end portion of the support is configured to fixedly engage with the container.

109. The applicator of claim 103, wherein the container has an opening in one end, said opening being configured to place the first reservoir in selective flow communication with the application member when the application member is engaged with the container.

110. The applicator of claim 109, wherein the opening places the first reservoir in flow communication with at least one passage defined by the application member.

111. The applicator of claim 110, wherein the first product is delivered through the opening in the container and into the passage defined by the application member upon selectively loading the application member with the first product.

112. The applicator of claim 111, wherein the passage is formed by a duct extending longitudinally through the application member.

113. The applicator of claim 111, wherein the application member is made of a foam material having a plurality of passages in the form of pores.

114. The applicator of claim 98, wherein the first end portion defines an opening configured to place the first reservoir in flow communication with the application member.

115. The applicator of claim 114, wherein the selective flow communication element includes a covering element and the opening in the first end portion is selectively closed off by the covering element.

116. The applicator of claim 115, wherein the covering element is configured to open the opening to establish flow of the first product from the first reservoir to the application member.

117. The applicator of claim 116, wherein the covering element is configured to open in response to a pressure increase in the first reservoir relative to the pressure of the applicator.

118. The applicator of claim 116, wherein the covering element is configured to open in response to a sufficient compressive force exerted on the container.

119. The applicator of claim 98, wherein the second reservoir is a lid configured to cover the application member during engagement with the second end portion of the support.

120. The applicator of claim 119, wherein the second product is provided near a top portion of the lid.

121. The applicator of claim 120, wherein the second product is chosen from a powder and a cake material.

122. The applicator of claim 121, wherein the second product is a material providing sun protection.

123. The applicator of claim 121, wherein the second product is a colored make-up product.

124. An applicator comprising:

a support configured to be removably provided on a container containing a first product, the support defining an opening;

an application member having a first end portion mounted on the support and a second end portion having an application face extending substantially perpendicular to a longitudinal axis of the application member, the application member being configured to convey the first product from the container to the application face via the opening; and a lid configured to removably cover the application member, the lid having a closed end portion containing a second product arranged such that the application face is capable of being pressed against the second product when the application member is covered with the lid.

125. The applicator of claim 124, wherein the application member is elastically compressible.

126. The applicator of claim 124, wherein the first product is chosen from a liquid and a semi-liquid material and the second product is chosen from a powder and a solid cake material.

127. The applicator of claim 124, wherein the lid is configured to be removably engaged with the support.

128. The applicator of claim 124, wherein the second product is one of poured and compacted into the closed end portion of the lid.

129. The applicator of claim 124, wherein the second product is one of poured and compacted into a cup mounted in the closed end portion of the lid.

130. The applicator of claim 124, wherein the second product is separated from a closed end of the lid by an elastically deformable member.

131. The applicator of claim 124, wherein the closed end portion of the lid is configured to move axially with respect to the application member when the lid covers the application member.

132. The applicator of claim 124, wherein the application member defines a passage extending from the opening in the support to the application face.

133. The applicator of claim 124, wherein the support includes a mounting mechanism chosen from a snap-fastener, a screw-fastener, and a push-fitting mechanism for removably mounting the support on the container.

134. An applicator comprising:

a support having a first end portion and a second end portion, the first end portion being configured to be removably provided on a first reservoir containing a first product;

a second reservoir containing a second product, the second reservoir being configured to be engageable with the support; and an application member extending from the second end portion of the support, the application member having an application face capable of being placed in contact with the second product when the second reservoir is engaged with the support, the application face extending substantially perpendicular to a longitudinal axis of the application member, wherein the application member is configured to be selectively loaded with at least one of the first product and the second product on the application face.

135. The applicator of claim 134, wherein the application member defines at least one passage and one of the first and second products is loaded onto the application face through the passage.

136. The applicator of claim 134, wherein the second end portion includes an engagement member for removable engagement with the second reservoir, said engagement member being chosen from a snap-fit mechanism and a threaded surface.

137. The applicator of claim 134, wherein the application member is configured to mix together the first and second products loaded thereon during application of the products to a surface.

138. The applicator of claim 134, further comprising the first reservoir containing the first product, wherein one of the first product and the second product is chosen from a liquid, a cream, and a gel, and the other of the first product and the second product is chosen from a powder and a solid cake material.

139. The applicator of claim 134, further comprising the first reservoir, wherein the first reservoir is formed by a container having a variable volume.

140. The applicator of claim 139, wherein the container includes at least one wall formed of a movable piston.

141. The applicator of claim 139, wherein the container includes at least one wall that is deformable.

142. The applicator of claim 141, wherein the container is a tube made of a material chosen from polyethylene and polypropylene.

143. The applicator of claim 141, wherein the container is a bottle.

144. The applicator of claim 139, wherein the first end portion of the support is configured to fixedly engage with the container.

145. The applicator of claim 139, wherein the container has an opening in one end, said opening being configured to place the first reservoir in selective flow communication with the application member when the application member is engaged with the container.

146. The applicator of claim 145, wherein the opening places the first reservoir in flow communication with at least one passage defined by the application member.

147. The applicator of claim 146, wherein the first product is delivered through the opening in the container and into the passage defined by the application member upon selectively loading the application member with the first product.

148. The applicator of claim 147, wherein the passage is formed by a duct extending longitudinally through the application member.

149. The applicator of claim 134, wherein the first end portion defines an opening configured to place the first reservoir in flow communication with the application member.

150. The applicator of claim 134, wherein the second reservoir is a lid configured to cover the application member during engagement with the second end portion of the support.

151. The applicator of claim 150, wherein the application face is configured to be in contact with a containment member disposed within the lid to hold the second product in the lid when the second end portion of the support is engaged with the lid.

152. The applicator of claim 150, wherein the second product is provided near a top portion of the lid.

153. The applicator of claim 152, wherein the top portion of the lid includes an actuator configured to selectively place the application face and the second reservoir in contact when the lid is engaged with the second end portion of the support.

154. The applicator of claim 153, wherein the actuator includes a diaphragm configured to move the second product with respect to the lid.

155. The applicator of claim 150, wherein the second product is chosen from a powder and a cake material.

156. The applicator of claim 155, wherein the second product is a material providing sun protection.

157. The applicator of claim 155, wherein the second product is a colored make-up product.

158. The applicator of claim 155, wherein the second product is configured to crumble upon contacting a liquid or semi-liquid material.

159. An applicator comprising:

a support configured to be removably provided on a container containing a first product, the support defining an opening;

an application member having a first end portion mounted on the support and a second end portion having an application face that is substantially planar, the application member being configured to convey the first product from the container to the application face via the opening; and a lid configured to removably cover the application member, the lid having a closed end portion containing a second product arranged such that the application face is capable of being pressed against the second product when the application member is covered with the lid.

160. The applicator of claim 159, wherein the application member is elastically compressible.

161. The applicator of claim 159, wherein the first product is chosen from a liquid and a semi-liquid material and the second product is chosen from a powder and a solid cake material.

162. The applicator of claim 159, wherein the lid is configured to be removably engaged with the support.

163. The applicator of claim 159, wherein the second product is one of poured and compacted into the closed end portion of the lid.

164. The applicator of claim 159, wherein the second product is one of poured and compacted into a cup mounted in the closed end portion of the lid.

165. The applicator of claim 159, wherein the second product is separated from a closed end of the lid by an elastically deformable member.

166. The applicator of claim 159, wherein the closed end portion of the lid is configured to move axially with respect to the application member when the lid covers the application member.

167. The applicator of claim 159, wherein the application member defines a passage extending from the opening in the support to the application face.

168. The applicator of claim 159, wherein the support includes a mounting mechanism chosen from a snap-fastener, a screw-fastener, and a push-fitting mechanism for removably mounting the support on the container.

169. An applicator comprising:

a support having a first end portion and a second end portion, the first end portion being configured to be removably provided on a first reservoir containing a first product;

a second reservoir containing a second product, the second reservoir being configured to be engageable with the support; and an application member extending from the second end portion of the support, the application member having an application face that is substantially planar and is capable of being placed in contact with the second product when the second reservoir is engaged with the support, wherein the application member is configured to be selectively loaded with at least one of the first product and the second product on the application face.

170. The applicator of claim 169, wherein the application member defines at least one passage and one of the first and second products is loaded onto the application face through the passage.

171. The applicator of claim 169, wherein the second end portion includes an engagement member for removable engagement with the second reservoir, said engagement member being chosen from a snap-fit mechanism and a threaded surface.

172. The applicator of claim 169, wherein the application member is configured to mix together the first and second products loaded thereon during application of the products to a surface.

173. The applicator of claim 169, further comprising the first reservoir containing the first product, wherein one of the first product and the second product is chosen from a liquid, a cream, and a gel, and the other of the first product and the second product is chosen from a powder and a solid cake material.

174. The applicator of claim 169, further comprising the first reservoir, wherein the first reservoir is formed by a container having a variable volume.

175. The applicator of claim 174, wherein the container includes at least one wall formed of a movable piston.

176. The applicator of claim 174, wherein the container includes at least one wall that is deformable.

177. The applicator of claim 176, wherein the container is a tube made of a material chosen from polyethylene and polypropylene.

178. The applicator of claim 176, wherein the container is a bottle.

179. The applicator of claim 174, wherein the first end portion of the support is configured to fixedly engage with the container.

180. The applicator of claim 174, wherein the container has an opening in one end, said opening being configured to place the first reservoir in selective flow communication with the application member when the application member is engaged with the container.

181. The applicator of claim 180, wherein the opening places the first reservoir in flow communication with at least one passage defined by the application member.

182. The applicator of claim 181, wherein the first product is delivered through the opening in the container and into the passage defined by the application member upon selectively loading the application member with the first product.

183. The applicator of claim 182, wherein the passage is formed by a duct extending longitudinally through the application member.

184. The applicator of claim 169, wherein the first end portion defines an opening configured to place the first reservoir in flow communication with the application member.

185. The applicator of claim 169, wherein the second reservoir is a lid configured to cover the application member during engagement with the second end portion of the support.

186. The applicator of claim 169, wherein the application face is configured to be in contact with a containment member disposed in the lid to hold the second product in the lid when the second end portion of the support is engaged with the lid.

187. The applicator of claim 185, wherein the second product is provided near a top portion of the lid.

188. The applicator of claim 187, wherein the top portion of the lid includes an actuator configured to selectively place the application face and the second reservoir in contact when the lid is engaged with the second end portion of the support.

189. The applicator of claim 188, wherein the actuator includes a diaphragm configured to move the second product with respect to the lid.

190. The applicator of claim 185, wherein the second product is chosen from a powder and a cake material.

191. The applicator of claim 190, wherein the second product is a material providing sun protection.

192. The applicator of claim 190, wherein the second product is a colored make-up product.

193. The applicator of claim 190, wherein the second product is configured to crumble upon contacting a liquid or semi-liquid material.

194. An applicator comprising:

a support configured to be removably provided on a container containing a first product, the support defining an opening;

an application member having a first end portion mounted on the support and a second end portion having an application face, the application member being configured to convey the first product from the container to the application face via the opening;

a lid configured to removably cover the application member, the lid having a closed end portion containing a second product arranged such that the application face is capable of being pressed against the second product when the application member is covered with the lid; and a containment member disposed in the lid to contain the second product in the closed end portion of the lid, the containment member being disposed between the second product and the application face when the application member is covered with the lid.

195. The applicator of claim 194, wherein the application member is elastically compressible.

196. The applicator of claim 194, wherein the first product is chosen from a liquid and a semi-liquid material and the second product is chosen from a powder and a solid cake material.

197. The applicator of claim 194, wherein the lid is configured to be removably engaged with the support.

198. The applicator of claim 194, wherein the second product is one of poured and compacted into the closed end portion of the lid.

199. The applicator of claim 194, wherein the second product is one of poured and compacted into a cup mounted in the closed end portion of the lid.

200. The applicator of claim 194, wherein the second product is separated from a closed end of the lid by an elastically deformable member.

201. The applicator of claim 194, wherein the closed end portion of the lid is configured to move axially with respect to the application member when the lid covers the application member.

202. The applicator of claim 194, wherein the containment member is chosen from a grating and a perforated mesh.

203. The applicator of claim 194, wherein the application member defines a passage extending from the opening in the support to the application face.

204. The applicator of claim 194, wherein the support includes a mounting mechanism chosen from a snap-fastener, a screw-fastener, and a push-fitting mechanism for removably mounting the support on the container.

205. An applicator comprising:

a support having a first end portion and a second end portion, the first end portion being configured to be removably provided on a first reservoir containing a first product;

a second reservoir containing a second product, the second reservoir being configured to be engageable with the support;

an application member extending from the second end portion of the support, the application member having an application face capable of being placed in contact with the second product when the second reservoir is engaged with the support; and a containment member disposed in the second reservoir to contain the second product in the second reservoir, the containment member being disposed between the second product and the application face when the second reservoir is engaged with the support, wherein the application member is configured to be selectively loaded with at least one of the first product and the second product on the application face.

206. The applicator of claim 205, wherein the application member defines at least one passage and one of the first and second products is loaded onto the application face through the passage.

207. The applicator of claim 205, wherein the second end portion includes an engagement member for removable engagement with the second reservoir, said engagement member being chosen from a snap-fit mechanism and a threaded surface.

208. The applicator of claim 205, wherein the application member is configured to mix together the first and second products loaded thereon during application of the products to a surface.

209. The applicator of claim 205, further comprising the first reservoir containing the first product, wherein one of the first product and the second product is chosen from a liquid, a cream, and a gel, and the other of the first product and the second product is chosen from a powder and a solid cake material.

210. The applicator of claim 205, further comprising the first reservoir, wherein the first reservoir is formed by a container having a variable volume.

211. The applicator of claim 210, wherein the container includes at least one wall formed of a movable piston.

212. The applicator of claim 210, wherein the container includes at least one wall that is deformable.

213. The applicator of claim 212, wherein the container is a tube made of a material chosen from polyethylene and polypropylene.

214. The applicator of claim 212, wherein the container is a bottle.

215. The applicator of claim 210, wherein the first end portion of the support is configured to fixedly engage with the container.

216. The applicator of claim 210, wherein the container has an opening in one end, said opening being configured to place the first reservoir in selective flow communication with the application member when the application member is engaged with the container.

217. The applicator of claim 216, wherein the opening places the first reservoir in flow communication with at least one passage defined by the application member.

218. The applicator of claim 217, wherein the first product is delivered through the opening in the container and into the passage defined by the application member upon selectively loading the application member with the first product.

219. The applicator of claim 218, wherein the passage is formed by a duct extending longitudinally through the application member.

220. The applicator of claim 205, wherein the first end portion defines an opening configured to place the first reservoir in flow communication with the application member.

221. The applicator of claim 205, wherein the second reservoir is a lid configured to cover the application member during engagement with the second end portion of the support.

222. The applicator of claim 221, wherein the lid includes a top wall, a side wall, and the containment member extends laterally within the lid proximal the top wall.

223. The applicator of claim 222, wherein the containment member is chosen from a grating and a mesh material that allows at least some of the second product to pass therethrough.

224. The applicator of claim 223, wherein the application face is configured to be in contact with the containment member when the second end portion of the support is engaged with the lid.

225. The applicator of claim 221, wherein the second product is provided near a top portion of the lid.

226. The applicator of claim 225, wherein the top portion of the lid includes an actuator configured to selectively place the application face and the second reservoir in contact when the lid is engaged with the second end portion of the support.

227. The applicator of claim 226, wherein the actuator includes a diaphragm configured to move the second product with respect to the lid.

228. The applicator of claim 221, wherein the second product is chosen from a powder and a cake material.

229. The applicator of claim 228, wherein the second product is a material providing sun protection.

230. The applicator of claim 228, wherein the second product is a colored make-up product.

231. The applicator of claim 228, wherein the second product is configured to crumble upon contacting a liquid or semi-liquid material.

232. An applicator comprising:

a support configured to be removably provided on a container containing a first product, the support defining an opening;

an application member having a first end portion mounted on the support and a second end portion having an application face, the application member being configured to convey the first product from the container to the application face via the opening;

a lid configured to removably cover the application member, the lid having a closed end portion containing a second product arranged such that the application face is capable of being pressed against the second product when the application member is covered with lid; and a containment member disposed in the lid to contain the second product in the closed end portion of the lid, the containment member comprising a porous member.

233. The applicator of claim 232, wherein the containment member is chosen from a grating and a perforated mesh.

234. An applicator comprising:

a support having a first end portion and a second end portion, the first end portion being configured to be removably provided on a first reservoir containing a first product;

a second reservoir containing a second product, the second reservoir being configured to be engageable with the support;

an application member extending from the second end portion of the support, the application member having an application face capable of being placed in contact with the second product when the second reservoir is engaged with the support; and a containment member disposed in the second reservoir to contain the second product in the second reservoir, the containment member comprising a porous member, wherein the application member is configured to be selectively loaded with at least one of the first product and the second product on the application face.

235. The applicator of claim 234, wherein the second reservoir is a lid configured to cover the application member during engagement with the second end portion of the support.

236. The applicator of claim 235, wherein the lid includes a top wall and a side wall, and the containment member extends laterally within the lid proximal the top wall.

237. The applicator of claim 236, wherein the containment member is chosen from a grating and a mesh material that allows at least some of the second product to pass therethrough.

238. The applicator of claim 237, wherein the application face is configured to be in contact with the containment member when the second end portion of the support is engaged with the lid.

239. The applicator of claim 234, wherein the containment member is chosen from a grating and a mesh material.

240. The applicator of claim 234, wherein the second product is chosen from a powder and a cake material.

241. An applicator comprising:

a support configured to be removably provided on a container containing a first the support defining an opening;

an elastically compressible application member having a first end portion mounted on the support and a second end portion having an application face, the application member being configured to convey the first product from the container to the application face via the opening; and a lid configured to removably cover the application member, the lid having a closed end portion containing a second product arranged such that the application face is capable of being pressed against the second product when the application member is covered with the lid.

242. The applicator of claim 241, wherein the first product is chosen from a liquid and a semi-liquid material and the second product is chosen from a powder and a solid cake material.

243. The applicator of claim 241, wherein the lid is configured to be removably engaged with the support.

244. The applicator of claim 241, wherein the second product is one of poured and compacted into the closed end portion of the lid.

245. The applicator of claim 241, wherein the second product is one of poured and compacted into a cup mounted in the closed end portion of the lid.

246. The applicator of claim 241, wherein the second product is separated from a closed end of the lid by an elastically deformable member.

247. The applicator of claim 241, wherein the closed end portion of the lid is configured to move axially with respect to the application member when the lid covers the application member.

248. The applicator of claim 241, wherein the application member is made of a porous material configured to absorb the first product and to convey the first product from the opening to the application face.

249. The applicator of claim 248, wherein the porous material is chosen from an open-cell foam, a semi-open-cell foam, and a felt.

250. The applicator of claim 241, wherein the application member defines a passage extending from the opening in the support to the application face.

251. The applicator of claim 241, wherein the support includes a mounting mechanism chosen from a snap-fastener, a screw-fastener, and a push-fitting mechanism for removably mounting the support on the container.

252. An applicator comprising:

a support having a first end portion and a second end portion, the first end portion being configured to be removably provided on a first reservoir containing a first product;

a second reservoir containing a second product, the second reservoir being configured to be engageable with the support; and an elastically compressible application member extending from the second end portion of the support, the application member having an application face capable of being placed in contact with the second product when the second reservoir is engaged with the support, wherein the application member is configured to be selectively loaded with at least one of the first product and the second product on the application face.

253. The applicator of claim 252, wherein the application member is configured to mix together the first and second products loaded thereon during application of the products to a surface.

254. The applicator of claim 252 further comprising the first reservoir containing the first product, wherein one of the first product and the second product is chosen from a liquid, a cream, and a gel, and the other of the first product and the second product is chosen from a powder and a solid cake material.

255. The applicator of claim 252, wherein the application member is made of a foam material having a plurality of passages in the form of pores.

256. The applicator of claim 252, wherein the second reservoir is a lid configured to cover the application member during engagement with the second end portion of the support.

257. The applicator of claim 256, wherein the second product is provided near a top portion of the lid.

258. The applicator of claim 257, wherein the top portion of the lid includes an actuator configured to selectively place the application face and the second reservoir in contact when the lid is engaged with the second end portion of the support.

259. The applicator of claim 258, wherein the actuator includes a diaphragm configured to move the second product with respect to the lid.

260. The applicator of claim 256, wherein the second product is chosen from a powder and a cake material.

261. The applicator of claim 260, wherein the second product is a material providing sun protection.

262. The applicator of claim 260, wherein the second product is a colored make-up product.

263. The applicator of claim 260, wherein the second product is configured to crumble upon contacting a liquid or semi-liquid material.

264. An applicator assembly for applying at least one of a first and a second product to a surface, comprising:

a container containing the first product;

an applicator comprising a support removably provided on the container, the support defining an opening, an application member having a first end portion mounted on the support and a second end portion having an application face, the application member being configured to convey the first product from the container to the application face via the opening, and a lid removably covering the application member, the lid having a closed end portion containing a second product arranged such that the application face is capable of being pressed against the second product when the application member is covered with the lid; and a dispensing member chosen from an airless pump and a one-way valve for dispensing the first product.

265. The applicator assembly of claim 264, wherein the container is chosen from a deformable tube, a bottle having at least one deformable wall, and a bottle defined in part by at least one movable piston.

266. The applicator assembly of claim 264, further comprising a plurality of lids containing second products having differing characteristics.

267. The applicator assembly of claim 266, wherein the second product in the lids is chosen from make-up products having at least one of differing shades and differing appearances.

268. The applicator assembly of claim 266, wherein the second product in the lids is chosen from products having differing sun protection factors.

269. The applicator assembly of claim 264, wherein the application member is made of a material chosen from materials having differing application characteristics.

270. The applicator assembly of claim 264, wherein the first product is chosen from a liquid, a cream, and a gel.

271. An applicator assembly comprising:

an applicator comprising a support having a first end portion and a second end portion, the first end portion being removably provided on a first reservoir containing a first product, a second reservoir containing a second product, the second reservoir being defined by a lid and engageable with the support, and an application member extending from the second end portion of the support, the application member having an application face capable of being placed in contact with the second product when the second reservoir is engaged with the support, wherein the application member is configured to be selectively loaded with at least one of the first product and the second product on the application face;

a container including the first reservoir; and a dispensing member chosen from an airless pump and a one-way valve for dispensing the first product.

272. The applicator assembly of claim 271, wherein the first product is chosen from a liquid, a gel, and a cream, and the second product is chosen from a powder and a solid cake material.

273. The applicator assembly of claim 271, wherein the second product includes a material providing sun protection.

274. The applicator assembly of claim 272, comprising a plurality of applicators, each applicator being configured to engage one of a plurality of lids, the second product in each of the plurality of lids providing differing sun protection.

275. The applicator assembly of claim 271, wherein the second product includes a colored make-up product.

276. The applicator assembly of claim 272, comprising a plurality of applicators, each applicator being configured to engage one of a plurality of lids, the second product in each lid having a differing color.

277. A process for applying at least one of a first product and a second product to skin, the process comprising:

providing an applicator comprising a support removably provided on a container containing a first product, the support defining an opening, an application member having a first end portion mounted on the support and a second end portion having an application face, the application member being configured to convey the first product from the container to the application face via the opening, and a lid removably covering the application member, the lid having a closed end portion containing a second product arranged such that the application face is capable of being pressed against the second product when the application member is covered with the lid;

loading the application face of the application member with at least one of the first and second products;

removing the lid from the application member; and placing the application face of the application member in contact with skin to thereby apply said at least one of the first and second products to the skin.

278. The process of claim 277, further comprising applying a compressive force to the container to load the application face with the first product.

279. The process of claim 277, wherein the placing of the lid on the application member loads the application face with the second product.

280. The process of claim 277, further comprising providing a plurality of applicators each having a lid containing a second product having a differing characteristic, and selecting one of the applicators based on the differing characteristic.

281. The process of claim 277, wherein at least one of the first and second products is a cosmetic product.

282. The process of claim 277, further comprising flowing the first product from the container to the application member, and removing the applicator from the container.

283. The process of claim 277, wherein both of the first and second products are applied to the skin.

284. A process for applying at least one of a first product and a second product to skin, the process comprising:

providing an applicator comprising a support having a first end portion and a second end portion, the first end portion being removably provided on a first reservoir containing a first product, a second reservoir containing a second product, the second reservoir being engageable with the support, and an application member extending from the second end portion of the support, the application member having an application face capable of being placed in contact with the second product when the second reservoir is engaged with the support, wherein the application member is configured to be selectively loaded with at least one of the first product and the second product on the application face;

loading the application face of the application member with at least one of the first and second products; and placing the application face of the application member in contact with skin to thereby apply said at least one of the first and second products to the skin.

285. The process of claim 284, further comprising applying a compressive force to the first reservoir to load the application face with the first product.

286. The process of claim 284, wherein the engaging of the second reservoir loads the application face with the second product.

287. The process of claim 284, further comprising providing a plurality of applicators each having a second reservoir containing a second product having a differing characteristic, and selecting one of the applicators based on the differing characteristic.

288. The process of claim 284, wherein at least one of the first and second products is a cosmetic product.

289. The process of claim 284, further comprising flowing the first product from the first reservoir to the application member, and removing the applicator from the first reservoir.

290. The process of claim 284, wherein both of the first and second products are applied to the surface.

* * * * *

UNITED STATES PATENT AND TRADEMARK OFFICE

CERTIFICATE OF CORRECTION

PATENT NO. : 6,334,727 B1
DATED : January 1, 2002
INVENTOR(S) : Jean-Louis H. Gueret It is certified that error appears in the above-identified patent and that said Letters Patent is hereby corrected as shown below:

Column 25,
Line 36, after "covered with" insert -- the --.

Column 26,
Line 17, after "a first" insert -- product, --.

Signed and Sealed this

Twenty-first Day of May, 2002

*Attest:*

*Attesting Officer*

JAMES E. ROGAN
*Director of the United States Patent and Trademark Office*